US009295350B2

(12) United States Patent
Smith et al.

(10) Patent No.: US 9,295,350 B2
(45) Date of Patent: Mar. 29, 2016

(54) SIPPY CUP SOFT SPOUT AND METHOD OF FORMING THE SAME

(71) Applicant: Mattel, Inc., El Segundo, CA (US)

(72) Inventors: Charlie Smith, East Amherst, NY (US); David Shapiro, East Aurora, NY (US); Domenic T. Gubitosi, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 30 days.

(21) Appl. No.: 14/021,299

(22) Filed: Sep. 9, 2013

(65) Prior Publication Data

US 2014/0069947 A1 Mar. 13, 2014

Related U.S. Application Data

(60) Provisional application No. 61/698,883, filed on Sep. 10, 2012.

(51) Int. Cl.
*A47G 19/22* (2006.01)

(52) U.S. Cl.
CPC ..... *A47G 19/2272* (2013.01)

(58) Field of Classification Search
CPC ..... A47G 19/2272; A47G 19/22; A47G 19/2205; A47G 19/2266
USPC ..... 220/714, 703, 711, 202, 203.24, 220/203.28, 203.29, 256.1, 256, 259.3, 220/254.1, 254; 215/11.5, 11.6, 260, 307; 264/154, 254
See application file for complete search history.

(56) References Cited

U.S. PATENT DOCUMENTS

| | | | | |
|---|---|---|---|---|
| 5,607,073 | A | 3/1997 | Forrer | |
| 5,893,472 | A | 4/1999 | Forrer | |
| 6,745,915 | B2 | 6/2004 | Rees | |
| 7,556,172 | B2 * | 7/2009 | Lane | 220/714 |
| 8,256,642 | B2 | 9/2012 | McNamara et al. | |
| 8,302,804 | B2 | 11/2012 | Seddon | |
| 2001/0020623 | A1 | 9/2001 | McDonough et al. | |
| 2002/0139767 | A1 * | 10/2002 | Budd | 215/387 |
| 2004/0000551 | A1 | 1/2004 | Flink et al. | |

(Continued)

FOREIGN PATENT DOCUMENTS

| | | | |
|---|---|---|---|
| JP | 2001-146249 | A | 5/2001 |
| JP | 2006230731 | A | 9/2006 |
| KR | 10-2009-0010114 | A | 1/2009 |

OTHER PUBLICATIONS

International Search Report for PCT/US2013/058976, dated Dec. 11, 2013.

*Primary Examiner* — Robert J Hicks
*Assistant Examiner* — Kareen Thomas
(74) *Attorney, Agent, or Firm* — Edell, Shapiro & Finnan, LLC

(57) ABSTRACT

A lid of a beverage container includes a base portion, a spout framework extending from the base portion, a valve positioned at the end of the spout framework, and a soft spout overmold that leaves the valve exposed. The soft spout overmold is sealingly engaged with the base portion and spout framework to prevent leaking of the contents of a beverage container which may be coupled to the lid. The valve is in fluid communication with the contents of a beverage container which may be coupled to the lid. The valve may contain a slit and when deformed, the slit transforms into an opening to allow contents of an attached beverage container to flow out of the beverage container.

19 Claims, 6 Drawing Sheets

(56) References Cited

U.S. PATENT DOCUMENTS

| | | | | |
|---|---|---|---|---|
| 2004/0099674 | A1 | 5/2004 | McDonough et al. | |
| 2007/0051727 | A1 | 3/2007 | Holley, Jr. | |
| 2007/0138121 | A1 | 6/2007 | Stribling et al. | |
| 2008/0035653 | A1* | 2/2008 | Meli | 220/717 |
| 2008/0128438 | A1* | 6/2008 | Lane A47G 19/2272 | 220/717 |
| 2008/0283537 | A1 | 11/2008 | Smith et al. | |
| 2010/0127006 | A1 | 5/2010 | Krammes et al. | |
| 2011/0056968 | A1* | 3/2011 | McNamara A47G 19/2272 | 220/714 |
| 2011/0151069 | A1 | 6/2011 | Harding | |
| 2011/0266295 | A1 | 11/2011 | Yacktman | |
| 2012/0091143 | A1 | 4/2012 | Hakim | |
| 2012/0248056 | A1 | 10/2012 | Fischer et al. | |

* cited by examiner

SIPPY CUP SOFT SPOUT AND METHOD OF FORMING THE SAME

CROSS REFERENCE TO RELATED APPLICATION AND CLAIM TO PRIORITY

This application claims priority under 35 U.S.C. 119(e) to U.S. Provisional Patent Application Ser. No. 61/698,883, entitled "Sippy Cup Soft Spout and Method for Forming the Same", filed Sep. 10, 2012, the disclosure of which is incorporated herein by reference in its entirety for all purposes.

FIELD OF THE INVENTION

The present invention relates to infant feeding lids. More specifically, the present invention is a soft spout for an infant's sippy cup that contains a rigid internal framework for support and a valve.

BACKGROUND OF THE INVENTION

Beverage containers for infants contain a variety of types of lids. One common infant beverage container lid includes a sippy spout designed for an infant to easily extract the contents of a beverage container without spilling those contents. Two types of sippy spout designs generally exist, a hard rigid spout and a soft spout that is deformable. The hard rigid spout may contain a valve that regulates the flow of the contents of the beverage container. Generally, the hard rigid sippy spouts equipped with valves have few problems related to leaking because the valve only allows the flow of fluid when a change of pressure occurs. Conversely, hard rigid sippy spouts may not be comfortable for an infant to bite down on.

Soft sippy spouts, however, are designed to be deformed, especially when bitten down on by an infant, making them more comfortable for an infant to place in their mouth and are more suitable for an infant who is teething. Soft sippy spouts, because of their easy ability to deform, do not regulate the flow of the contents of the beverage container as well as the valve system in hard sippy spouts. The soft sippy spouts can easily be deformed by an infants hands or any other force applied to the spout, causing the contents to flow uncontrollably out of the beverage container.

Therefore, what is needed is a combination of the deformability and comfort of a soft spout with a valve like a hard spout to regulate the flow of the contents of a beverage container.

SUMMARY OF THE INVENTION

According to one exemplary embodiment of the present invention, a lid for a beverage container includes a first portion, a first support member extending substantially vertically from the first portion, and a second support member extending substantially vertically from the first portion. In this embodiment, the first and second support members each include a distal end, and a valve may formed between, or proximate to, the distal end of the first support member and the distal end of the second support member. This embodiment further includes second portion sealingly displaced on the first portion and surrounding the first support member and the second support member, where the second portion enables the valve to provide fluid communication with the contents of the beverage container to which the lid is attached.

BRIEF DESCRIPTION OF THE DRAWINGS

Like reference numerals have been used to identify like elements throughout this disclosure.

DETAILED DESCRIPTION OF THE INVENTION

Figure 1:
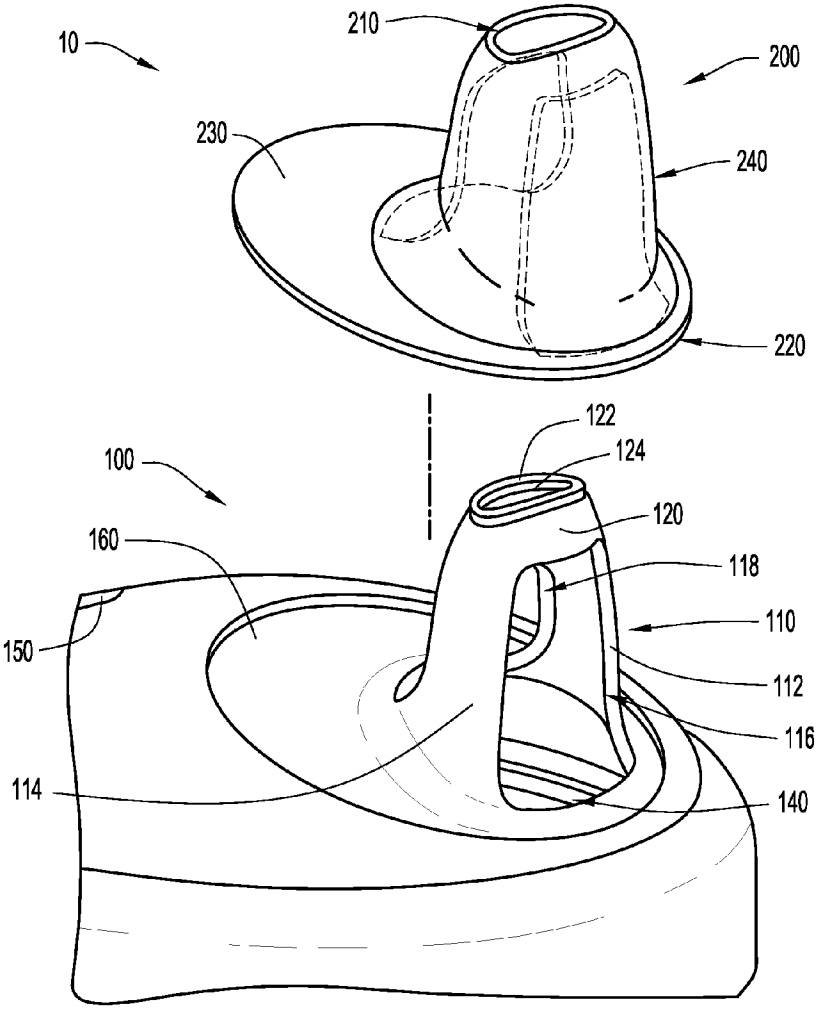
FIG. 1 shows an exploded view of a first embodiment of a lid in accordance with the present invention.

Referring to FIG. 1 at least one exemplary embodiment of a lid 10 in accordance with the present invention is shown. The lid 10 generally includes a base portion 100, spout framework 110, and a soft spout overmold 200. In one embodiment, the spout framework 110 contains a first support member or first frame portion 112 and a second support member or second frame portion 114. Moreover, the base portion 100 contains an opening 140 designed to provide access to a beverage container when the lid 10 is attached to a beverage container. As shown in FIG. 1, the first frame portion 112 and the second frame portion 114 extend substantially vertically from the base portion 100 of the lid 10. The first and second frame portions 112, 114 extend from the base portion 100 proximate to the base opening 140 and are substantially parallel to one another. Further, connecting the distal ends of the first and second frame portions 112, 114 is a bridge 120. Disposed within the bridge 120 is a valve 122. Outlined by the base portion 100, first frame portion 112, second frame portion 114, and bridge 120 is a front aperture 116 and a rear aperture 118. Furthermore, in this embodiment, the valve 122 is positioned above the base opening 140 in vertical alignment with the base opening 140. In other embodiments, more than two support portions may extend from the base, and in directions other than substantially vertical. In addition, in other embodiments, the valve 122 may be positioned in various positions other than being in vertical alignment with the base opening 140. In addition, an air vent 150 is located on the base 100. The air vent 150 is positioned on the base 100 at a location opposite of the positioning of the spout framework 110 on the base 100.

Continuing with FIG. 1, for one embodiment of the lid 10, the base portion 100 contains a base indent 160. Additionally, the lid 10 includes a soft spout overmold 200. The soft spout overmold 200 is configured to be disposed on the base portion 100 and around the spout framework 110. The soft spout overmold 200 includes a base 230 that is configured to rest within the base indent 160 of the base portion 100. The soft spout overmold 200 is sealingly engaged with the base portion 100 and spout framework 110 to prevent leaking of the contents of a beverage container which may be coupled to the lid 10. Furthermore, the soft spout overmold 200 contains a first opening or outlet 210 oriented on the top of the soft spout overmold 200 and a second opening 220 oriented on the bottom of the soft spout overmold 200. More specifically, the soft spout overmold 200 is configured to form a spout 240, and the first opening 210 is positioned on the end of the spout 240. The first opening 210 of the spout 240 leaves the valve 122 exposed.

The base portion 100 is constructed from a rigid material, such as polypropylene. Furthermore, the spout framework 110, specifically the first frame portion 112, second frame portion 114, and bridge 120, are constructed from a rigid material, such as polypropylene. Moreover, the soft spout overmold 200 and the valve 122 are constructed from flexible, non-rigid materials, such as a soft thermoplastic elastomer. The valve 122 may be constructed as a flat, concave, or convex shaped valve with a slit 124 through the valve 122. With the soft spout overmold 200 positioned on the base portion 100 of the lid 10, the valve 122 remains exposed. As a pressure differential is applied to the valve 122, the valve 122 deforms and the slit 124 transforms into an opening that provides fluid communication with a beverage container that is coupled to the lid 10. Furthermore, the front and rear apertures 116, 118 of the spout framework 110 enable the spout 240 of the soft spout overmold 200 to deform into the front aperture 116 and/or rear aperture 118 of the spout framework 110. The deformation of the spout 240 of the soft spout overmold 200 allows for a change in pressure behind the valve 122, causing the valve 122 to deform and the slit 124 of the valve 122 to transform into an opening, providing fluid communication with a beverage container coupled to the lid 10. Deformation of the valve 122 and the slit 124 may additionally be induced by providing suction to the valve 122 and the spout 240.

One exemplary method of forming the lid 10 in accordance with the present invention is as follows:

a. mold base 100 and spout framework 110 from a semi-rigid polypropene (PP), a thermoplastic polymer;
b. overmold valve 122 onto to base 100 and spout framework 110, where the valve is formed from a soft thermoplastic elastomer (TPE); and
c. overmold the soft spout overmold 200 onto the base 100, spout framework 110, and valve 122 assembly, the soft spout overmold 200 also being formed from a soft thermoplastic elastomer (TPE).

Figure 2:
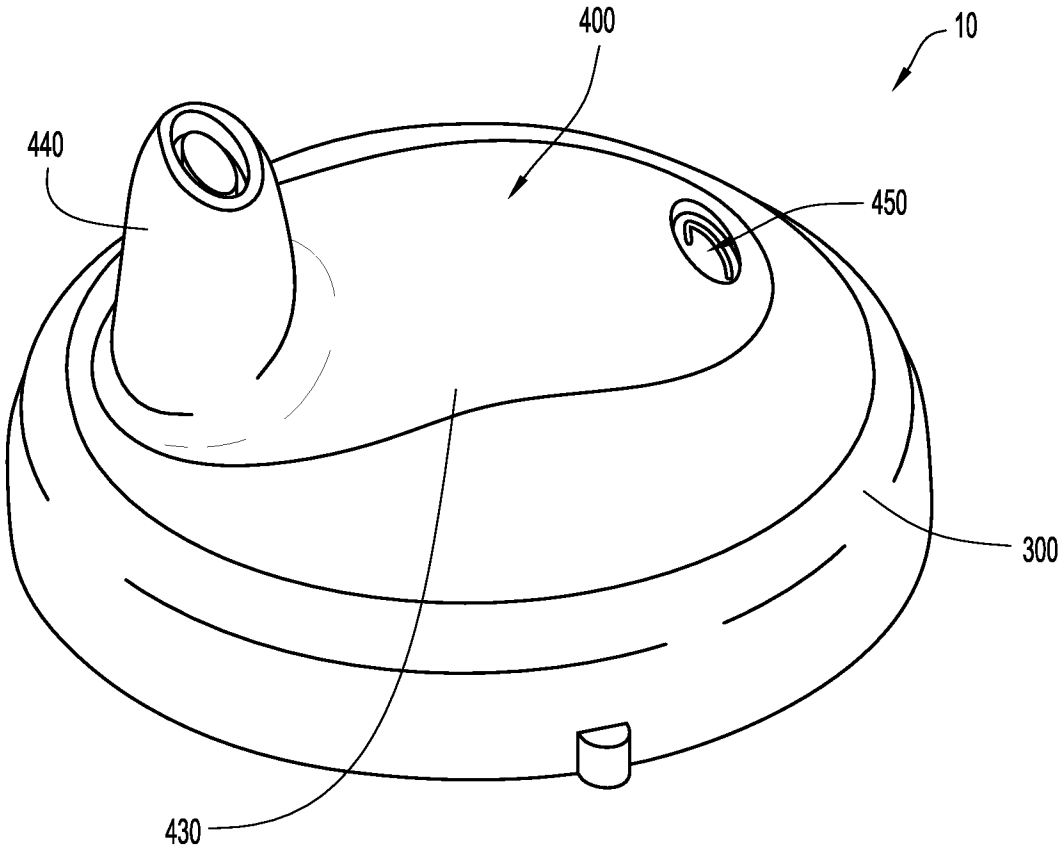
FIG. 2 shows a perspective view of a second embodiment of a lid in accordance with the present invention.
Figure 3:
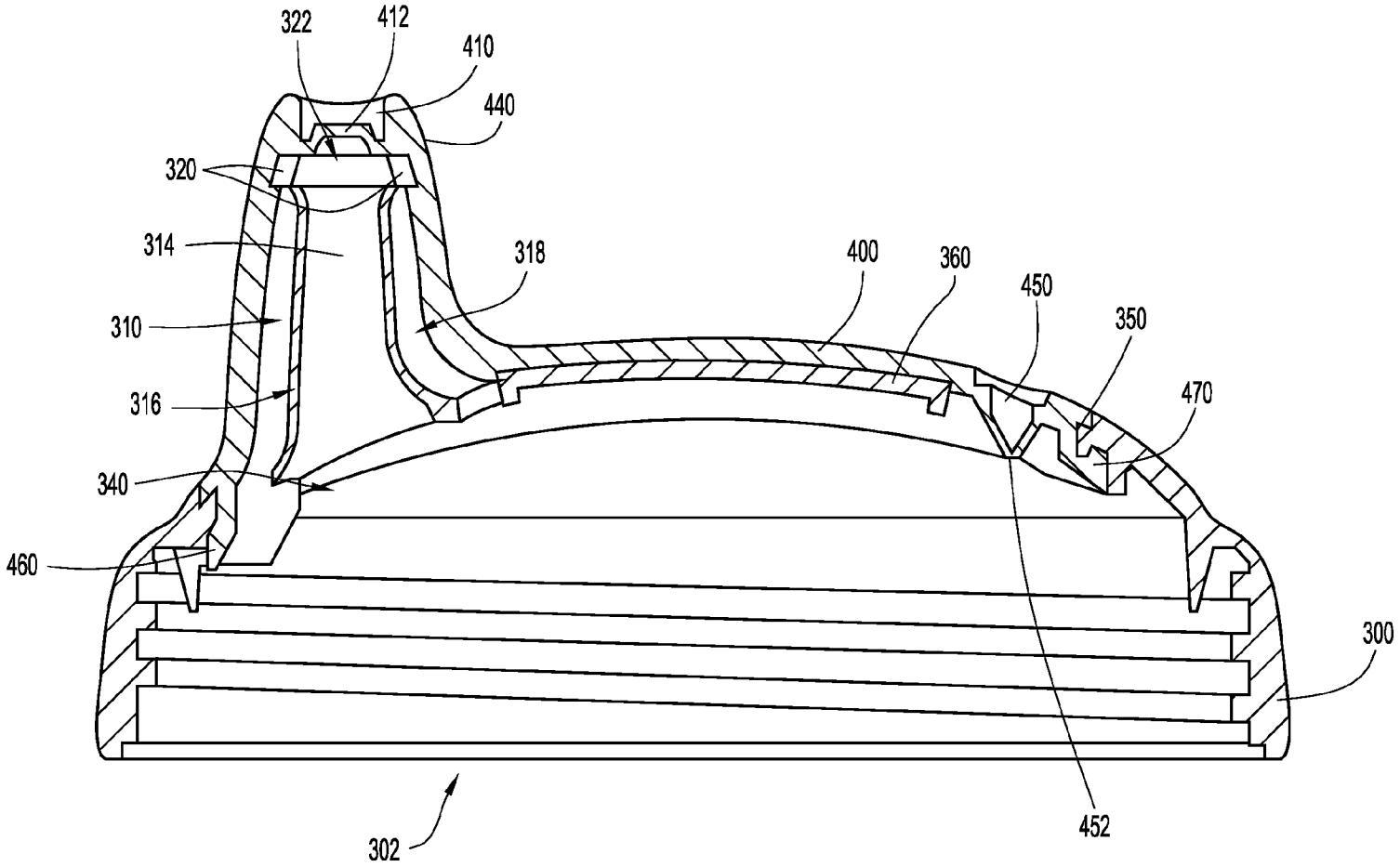
FIG. 3 shows a cross-sectional view of the lid of FIG. 2.
Figure 4:
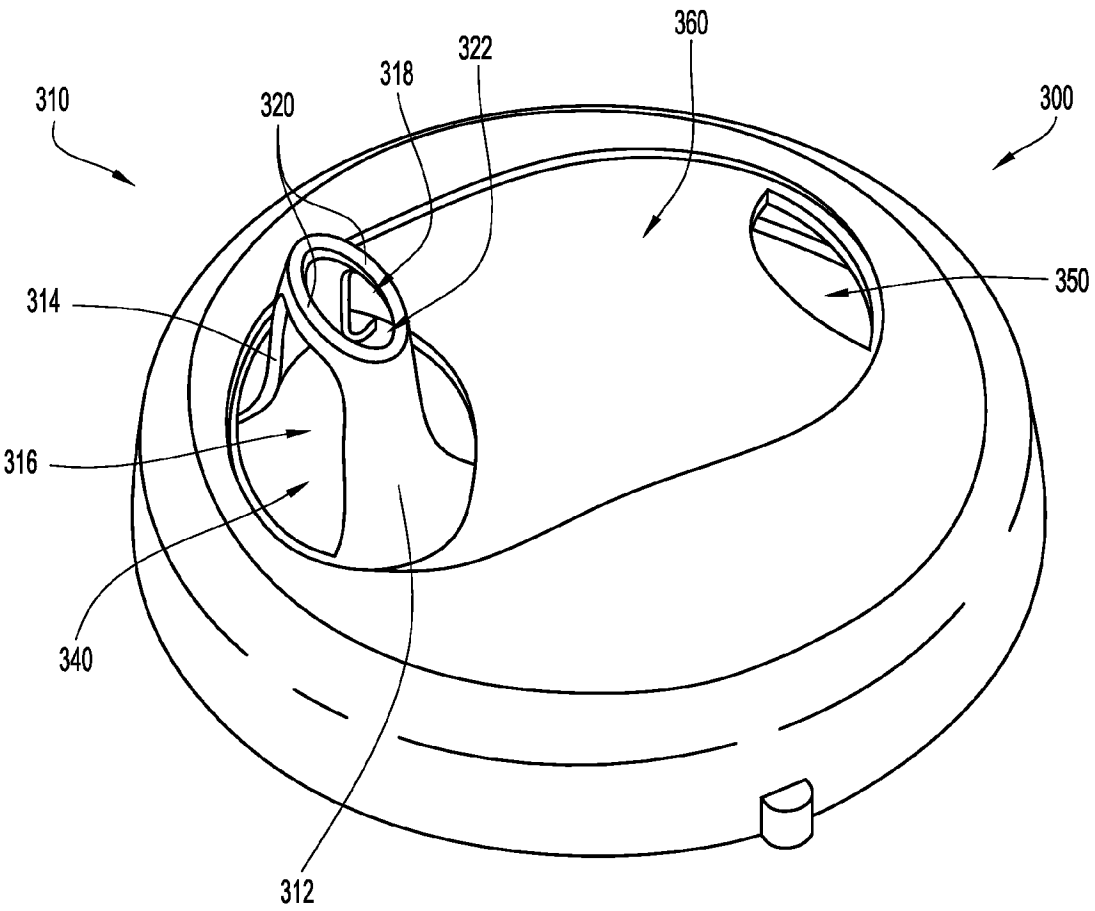
FIG. 4 shows a perspective view of the base of the lid of FIG. 2.

Illustrated in FIGS. 2-6 is a second embodiment of a lid 10 in accordance with the present invention. As illustrated in FIGS. 2 and 3, the lid 10 generally includes a base portion (first portion) 300 and a soft spout overmold (second portion) 400. As best illustrated in FIGS. 3 and 4, the base 300 includes a spout framework 310. The spout framework 310 contains a first support member or first frame portion 312 and a second support member or second frame portion 314. Moreover, the base portion 300 contains a base opening 340 designed to provide access to a beverage container when the lid 10 is attached to a beverage container. As shown in FIG. 4, the first frame portion 312 and the second frame portion 314 extend substantially vertically from the base portion 300 of the lid 10. The first and second frame portions 312, 314 extend from the base portion 300 proximate to the base opening 340 and are substantially parallel to one another. Further, connecting the distal ends of the first and second frame portions 312, 314 is a bridge 320. Outlined by the base portion 300, first frame portion 312, second frame portion 314, and bridge 320 is a front aperture 316, a rear aperture 318, and a top aperture 322. In addition, an air vent opening 350 is located on the base portion 300. The air vent opening 350 is positioned on the base portion 300 at a location opposite of the positioning of the spout framework 310 on the base portion 300. The base portion 300 further includes a base indent 360 that extends across the base 300 from the air vent opening 350 to the spout framework 310. The base indent 360 is a depression in the base portion 300. In other embodiments, more than two support portions may extend from the base, and in directions other than substantially vertical.

Figure 5:
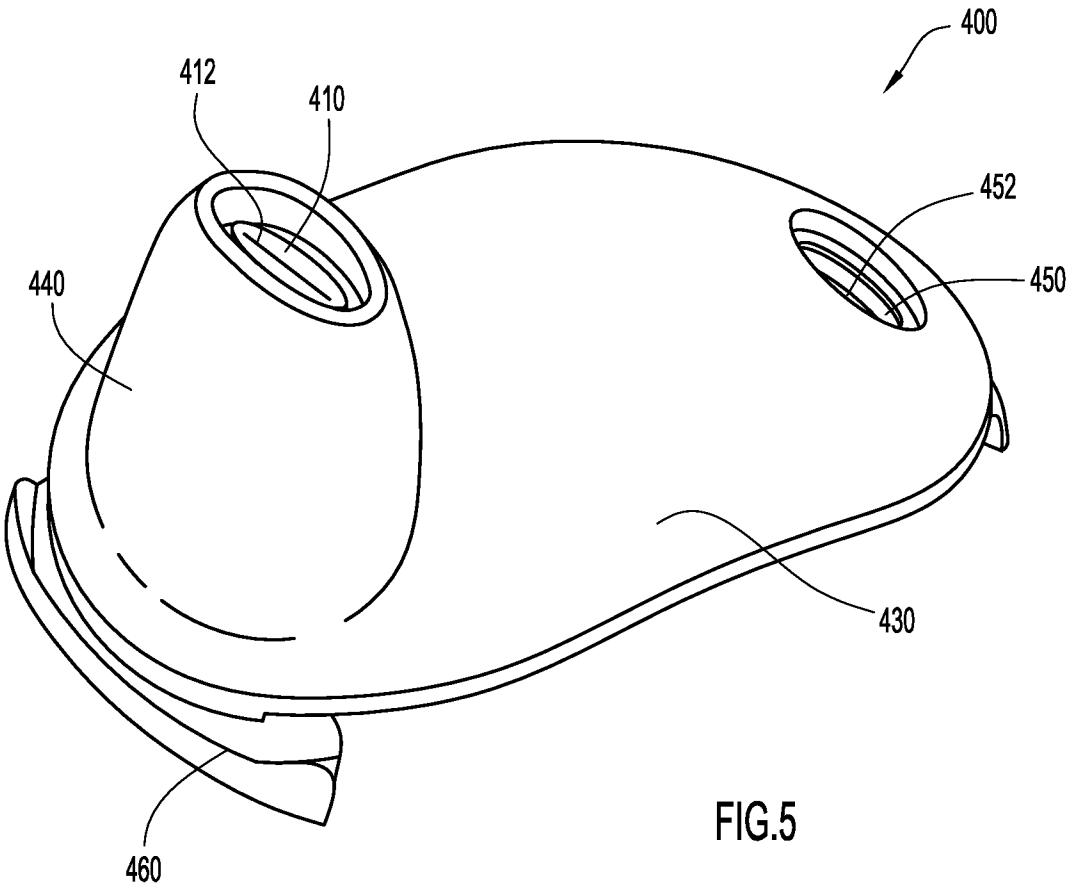
FIG. 5 shows a front perspective view of the overmold of the lid of FIG. 2.
Figure 6:
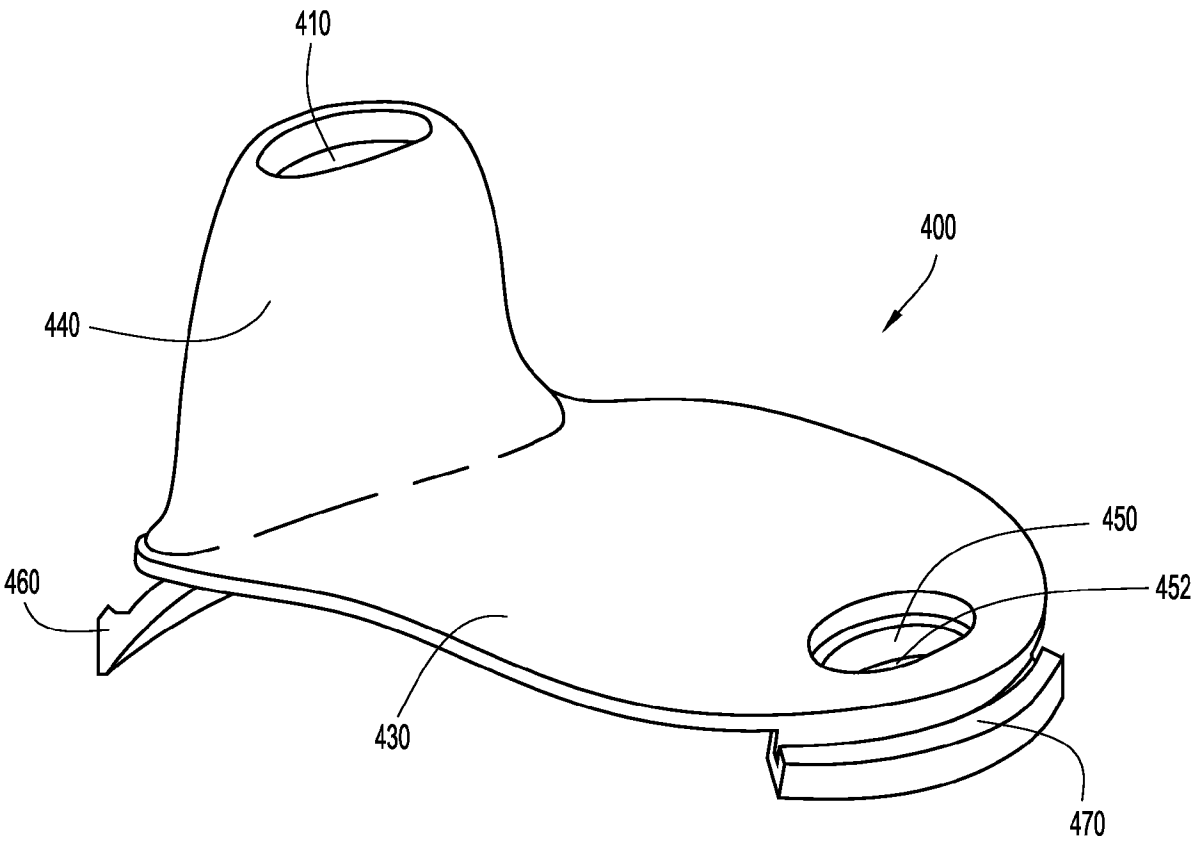
FIG. 6 shows a rear perspective view of FIG. 5.

Referring to FIGS. 3, 5, and 6, the lid 10 includes an overmold 400 configured to be disposed on the base portion 300 and cover the spout framework 310. The soft spout overmold 400 includes a base 430 that is configured to rest within the base indent 360 of the base portion 300. The soft spout overmold 400 is sealingly engaged with the base portion 300 and spout framework 310 to prevent leaking of the contents of a beverage container which may be coupled to the lid 10. Furthermore, as best illustrated in FIG. 3, this embodiment of the overmold 400 is configured to form a spout 440 around the spout framework 310 and contain a valve 410 disposed on the top of the spout 440. The valve 410 is positioned above and in vertical alignment with the bridge 320 and top aperture 322 to be in fluid communication with the top aperture 322. As illustrated in FIGS. 2 and 3, the base 430 of the overmold 400 extends from the formed spout 440 across the base indent 360 of the base portion 300 to the air vent opening 350. As best illustrated in FIG. 3, an air vent 450 is formed by the overmold 400 in the air vent opening 350.

Referring to FIGS. 3, 5, and 6, the overmold 400 includes a forward securing member 460 and a rearward securing member 470. The forward securing member 460 is formed in the overmold 400 proximate to the spout 440. The rearward securing member 470 is formed in the overmold 400 proximate to the air vent 450. As best illustrated by FIG. 3, the forward securing member 460 extends downwardly from the spout 440 and into the base opening 340. As illustrated, the forward securing member 460 extends into the base opening 340 and is molded to the underside 302 of the base portion 300. Similarly, the rearward securing member 470 extends downwardly from the overmold 400 proximate to the air vent 450 and into the air vent opening 350 of the base portion 300. Similar to the forward securing member 460, the rear securing member 470 extends into the air vent opening 350 and is molded to the underside 302 of the base portion 300. The forward and rearward securing members 460, 470 help to secure the overmold 400 onto the base portion 300.

The base portion 300 is constructed from a rigid material, such as polypropylene. Furthermore, the spout framework 310, specifically the first frame portion 312, second frame portion 314, and bridge 320, are constructed from a rigid material, such as polypropylene. Moreover, the overmold 400 is constructed from flexible, non-rigid materials, such as a soft thermoplastic elastomer. The valve 410 formed in the spout 440 may be constructed as a flat, concave, or convex shaped valve with a slit 412 through the valve 410. The air vent 450 is configured to have a V-shape cross section, as illustrated in FIG. 3, where a slit 452 is formed in the apex of the air vent 450. As a pressure differential is applied to the valve 410, the valve 410 deforms and the slit 412 transforms into an opening that provides fluid communication with a beverage container that is coupled to the lid 10. The air vent 450 also deforms when a pressure differential is applied to the valve 410, and the slit 452 transforms into an opening that allows air into the beverage container that is coupled to the lid 10 as fluid flows out of the spout 440 and the valve 410. Furthermore, the front and rear apertures 316, 318 of the spout framework 310 enable the spout 440 of the overmold 400 to deform into the front aperture 316 and/or rear aperture 318 of the spout framework 310. The deformation of the spout 440 of the overmold 400 allows for a change in pressure behind the valve 410, causing the valve 410 to deform and the slit 412 of the valve 410 to transform into an opening, providing fluid communication with a beverage container coupled to the lid 10. Deformation of the valve 410 and the slit 412, along with air vent 450 and slit 452, may additionally be induced by providing suction to the valve 410 and the spout 440.

One exemplary method of forming the lid 10 in accordance with the present invention is as follows:

a. mold base 300 and spout framework 310 from a semi-rigid polypropene (PP), a thermoplastic polymer;

b. overmold the overmold 400 onto the base 300 and spout framework 310, with the forward securing members 460 extending through the base opening 340 and securing to the interior 302 of the base 300 and the rearward securing member 470 extending through the air vent opening 350 and securing to the interior 302 of the base 300, the overmold 400 being formed into a spout 440 with a valve 410 and into an air vent 450, the overmold 400 also being formed from a soft thermoplastic elastomer (TPE);

c. cutting a slit 412 into the spout 440 formed in the overmold 400 and a slit 452 in the air vent 450.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A lid for a beverage container comprising:

a first portion of a rigid material, the first portion comprising:

a first support member extending from a base, the first support member comprises a distal end; and a second support member extending from the base parallel to the first support member, the second support member comprises a distal end; and a second portion of a flexible non-rigid material, the second portion sealingly disposed on the first portion and encompassing the first support member and the second support member, the second portion forming an outlet proximate the distal end of the first support member and the distal end of the second support member, wherein the second portion is configured to flex between the first support member and the second support member when a pressure is applied to the outlet.

2. The lid as set forth in claim 1, wherein the flexible non-rigid material is resilient.

3. The lid as set forth in claim 1, wherein the second portion further comprises:

a valve disposed proximate the distal end of the first support member and the distal end of the second support member.

4. The lid as set forth in claim 1, further comprising:

a bridge member connecting the distal end of the first support member and the distal end of the second support member.

5. The lid as set forth in claim 1, further comprising:

an aperture disposed on the first portion between the first support member and the second support member.

6. The lid as set forth in claim 1, further comprising:

an opening disposed on the first portion at a location different from the first support member and the second support member.

7. The lid as set forth in claim 6, further comprising:

an air vent disposed on the second portion and configured to be in fluid communication with the opening on the first portion.

8. The lid as set forth in claim 1, wherein the first support member and the second support member extend substantially vertically from the first portion.

9. A lid for a beverage container comprising:

a first portion including a base;

a first support member extending from the base, the first support member comprises a distal end;

a second support member extending from the base parallel to the first support member, the second support member comprises a distal end;

a valve coupled to, and disposed between, the distal end of the first support member and the distal end of the second support member; and a second portion sealingly displaced on the first portion and encompassing the first support member and the second support member, the second portion exposing the valve.

10. The lid as set forth in claim 9, wherein the first portion, first support member, and second support member are constructed from a substantially rigid material.

11. The lid as set forth in claim 9, wherein the second portion is constructed from a substantially flexible and resilient material.

12. The lid as set forth in claim 9, further comprising:

a bridge member connecting the distal end of the first support member and the distal end of the second support member, the valve being formed on the bridge member.

13. The lid as set forth in claim 9, further comprising:

an aperture disposed on the first portion between the first support member and the second support member, the aperture being in fluid communication with the valve.

14. The lid as set forth in claim 9, further comprising:

an air vent disposed on the first portion at a location different from the first support member and the second support member.

15. The lid as set forth in claim 9, wherein the first support member and the second support member extend substantially vertically from the first portion.

16. A method of manufacturing a lid for a beverage container comprising the steps of:

molding a first portion from a material with rigid material, the first portion including (i) a first support member extending from the first portion, the first support member comprising a distal end, and (ii) a second support member extending from the first portion parallel to the first support member, the second support member also comprising a distal end;

overmolding a valve from a material with flexible non-rigid material between the distal end of the first support member and the distal end of the second support member; and overmolding a second portion from a flexible non-rigid material onto the first portion, the second portion surrounding the first support member and the second support member and exposing the valve.

17. The method as set forth in claim 16, further comprising the step of:

molding the first portion with an air vent opening.

18. The method as set forth in claim 17, further comprising the step of:

overmolding a third portion from a flexible non-rigid material onto the first portion so the third portion covers the air vent opening.

19. The method as set forth in claim 18, further comprising the step of:

cutting at least one slit in both the valve and the third portion.

* * * * *